US010458751B2

(12) United States Patent
Rocque

(10) Patent No.: US 10,458,751 B2
(45) Date of Patent: Oct. 29, 2019

(54) MARKSMAN POSITIONING DEVICE

(71) Applicant: William Rocque, Augusta, ME (US)

(72) Inventor: William Rocque, Augusta, ME (US)

( * ) Notice: Subject to any disclaimer, the term of this patent is extended or adjusted under 35 U.S.C. 154(b) by 0 days.

(21) Appl. No.: 15/783,631

(22) Filed: Oct. 13, 2017

(65) Prior Publication Data

US 2018/0128575 A1 May 10, 2018

Related U.S. Application Data

(60) Provisional application No. 62/418,685, filed on Nov. 7, 2016.

(51) Int. Cl.
*F41G 1/38* (2006.01)
*F41G 1/42* (2006.01)

(52) U.S. Cl.
CPC *F41G 1/38* (2013.01); *F41G 1/42* (2013.01)

(58) Field of Classification Search
CPC ... F41G 1/38; F41G 1/44; F41G 1/345; F41G 1/383; F41G 1/12; F41G 1/42
USPC ..... 42/113, 120, 122, 129, 130
See application file for complete search history.

(56) References Cited

U.S. PATENT DOCUMENTS 2,807,981 A * 10/1957 Barnes ..... G02B 27/32 359/427
2,889,629 A * 6/1959 Darkenwald ..... F41G 1/383 359/511
3,131,477 A * 5/1964 Thomas ..... F41G 1/383 359/511
3,744,133 A * 7/1973 Fukushima ..... F41G 1/54 33/297
3,777,404 A * 12/1973 Oreck ..... F41G 1/30 359/424
4,616,421 A * 10/1986 Forsen ..... F41G 1/12 42/122

(Continued)

OTHER PUBLICATIONS

Statement of Facts by William Rocque and accompanying Exhibits, 4 pages—Provides information on disclosure of pliable material embodiment as well as sales of framed lens products devoid of alignment patterns. Exhibits A and B of the Statement of Facts depict website screen-shots of the respective embodiment and products which are currently available at https://www.bulzeyepro.com/optical-boosters.php and https://www.bulzeyepro.com/parallax-killer.php.

*Primary Examiner* — Michael D David
(74) *Attorney, Agent, or Firm* — Patent Alloy, LLC; Leonard Agneta

(57) ABSTRACT

Device and related methods for improving the accuracy and precision of firearms fitted with optical sights. The device comprises a small alignment pattern for indexing against a small, central region of a target picture aimpoint or reticle. The alignment pattern is applied to an auxiliary lens fixed in position externally behind an ocular lens. The auxiliary lens is supported by a frame secured to the optical sight or the auxiliary lens is made to adhere to the outside surface of the ocular lens. Some embodiments refract or condition light to improve target pictures. Alternatively, an alignment pattern, without an auxiliary lens, is applied directly to or made integral with an ocular lens during the manufacture of an optical sight. In general, referencing the alignment pattern with the reticle, by adjusting eye placement until a desired alignment is observed, provides consistent shooter positioning and reduced parallax.

14 Claims, 4 Drawing Sheets

(56) References Cited

U.S. PATENT DOCUMENTS 4,850,113 A * 7/1989 Doll ..... F41G 1/42 42/130
5,005,308 A * 4/1991 Parks ..... F41G 1/38 33/366.21
5,223,650 A * 6/1993 Finn ..... F41G 1/38 42/122
5,442,860 A * 8/1995 Palmer ..... F41G 1/545 33/286
5,499,455 A * 3/1996 Palmer ..... F41G 1/545 33/DIG. 21
5,657,571 A * 8/1997 Peterson ..... F41G 1/44 42/119
5,878,504 A * 3/1999 Harms ..... F41G 1/545 33/286
6,289,625 B1 * 9/2001 Phares ..... F41G 1/38 42/111
6,811,268 B2 * 11/2004 Watson ..... F41G 1/383 359/511
6,862,833 B1 * 3/2005 Gurtner ..... F41G 1/545 42/120
7,100,319 B2 * 9/2006 Paige ..... F41G 1/54 33/286
7,100,321 B2 * 9/2006 Holmberg ..... F41C 27/00 42/114
7,530,193 B2 * 5/2009 Williamson, IV ..... F41G 1/44 42/132
8,286,383 B2 10/2012 Matthews
D707,324 S * 6/2014 Radau ..... D22/109
8,739,454 B2 * 6/2014 Erdle ..... F41G 1/32 42/144
8,739,677 B1 * 6/2014 Robbins ..... F41G 1/545 42/121
D715,392 S * 10/2014 Cheng ..... D22/109
D721,780 S * 1/2015 Cheng ..... D22/109
9,285,187 B2 * 3/2016 Stockdill ..... F41G 1/12
9,297,615 B2 * 3/2016 Meinert ..... F41G 1/387
9,328,995 B1 * 5/2016 Hancosky ..... F41G 1/345
9,429,390 B2 * 8/2016 Stockdill ..... F41G 1/38
9,759,519 B2 * 9/2017 Hancosky ..... F41G 1/38
9,869,527 B2 * 1/2018 Hancosky ..... F41G 1/38
9,874,421 B2 * 1/2018 Stockdill ..... F41G 1/44
D813,338 S * 3/2018 Meinert ..... D22/108
2004/0025397 A1 * 2/2004 Malley ..... F41G 1/08 42/122
2004/0201886 A1 * 10/2004 Skinner ..... G02B 23/10 359/399
2009/0049733 A1 * 2/2009 Matthews ..... F41G 1/38 42/122

* cited by examiner

MARKSMAN POSITIONING DEVICE

CROSS REFERENCE TO RELATED APPLICATIONS

This application claims the benefit of U.S. Provisional Application No. 62/418,685, filed Nov. 7, 2016, the disclosure of which is hereby incorporated by reference in its entirety.

BACKGROUND OF THE INVENTION

Field of the Invention

This invention is directed to the field of firearm sights. More particularly, the invention relates to devices for consistently positioning a shooter with respect to a firearm fitted with optical sights.

Description of the Related Art

A consistent connection between marksman and firearm is necessary for repeatable bullet placement. Variations in hold and positioning are known to affect the performance of a firearm as well as the characteristics of the sight picture that is presented to a marksman. Inconsistent eye positioning is especially problematic for firearms fitted with higher powered optical sights due to the phenomenon of parallax.

In general, optical sights incorporate an internal reticle, such as a cross-hair or other referencing feature, to align an expected trajectory of a firearm projectile with a desired target. Light is typically gathered by an optical sight through one or more transparent components functioning as an objective lens. Within the sight, the gathered light forms an image which is perceived by the shooter as being overlaid by the reticle. Together, the image and reticle create a sight picture which is used to aim the trajectory of the firearm at the target. A marksman views the sight picture through an ocular lens situated in the posterior portion, i.e., the ocular bellhousing, of the sight. Looking through the sight with the target and reticle aligned, the marksman fires the projectile expecting that it will contact the target.

With an optical sight properly adjusted to a firearm, mere alignment of the reticle and target in the target picture of optical sight is often adequate for successful projectile placement. However, in circumstances requiring greater degrees of accuracy, such as would be needed for precise projectile placement over a long distance, a projectile may miss the expected target if the marksman's eye is incorrectly positioned. More specifically, if when shooting at a target the marksman's eye position with respect to the optical sight differs from the eye position that was used when the sight was adjusted or "zeroed" to the firearm, the target picture may be altered enough to direct the projectile off target.

Erroneous bullet placement caused by inconsistent positioning is well recognized in the art. Indeed, long distance marksmen are taught to use consistent positioning to obtain predictable function and target pictures when using their firearms. As would be expected, various techniques and devices are used to improve marksmanship. Long distance shooters are commonly trained to "weld" themselves to their rifles and stocks are designed to provide enhanced contact points for encouraging consistent shooter positioning.

Although telescopic sights are understood to be subject to parallax error, such sights provide significant advantages, particularly for marksman with compromised eyesight or those pursuing targets requiring great accuracy. Aim enhancing devices for further improving the performance of telescopic sights are also popular. Some aim enhancing devices magnify or improve the capacity of a shooter to bring target picture components into focus. For instance, Optical Boosters™ marketed by BulzEyePro® of Augusta, Me. incorporate lenses of varying diopters to meet a range of needs for different shooters. While such devices can improve the sight picture of telescopic sights, they do little to reduce parallax.

Other devices have been proposed to specifically reduce parallax error. For instance, U.S. Pat. No. 8,286,383 describes a rifle scope aligning device comprising a housing with multiple peripheral markings. To reduce parallax, the housing markings are aligned with the outer edges of the scope reticle while the aim of the rifle is held on target. However, viewing both the reticle and the markings around the circumference of the target picture simultaneously with a target centered in the reticle is difficult for most shooters, particularly when the target is small.

In situations involving long distance projectile placement with optical sights, parallax continues to be a challenge. In light of the existing shortcomings of the prior art described above, there is disclosed herein a device for improving the accuracy and precision of firearm projectile placement caused by inconsistent marksman eye positioning. A position alignment feature of the device, aka an "alignment pattern", is readily observed while viewing the central region of a target picture and allows the device to provide advantages over the prior art.

SUMMARY OF THE INVENTION

A marksman positioning device of the present invention provides a marksman with consistent eye placement, reducing parallax error with minimal obstruction. Some embodiments, designed to be applied to an existing optical sight, may provide the additional advantage of improving the target picture produced by the sight. In other embodiments, devices of the present invention relate to the manufacture of optical sights having an alignment pattern applied to the ocular lens for the purpose of reducing parallax.

A marksman positioning device of the present invention comprises a small alignment pattern adapted to be secured to or incorporated within the ocular of a firearm scope or other optical sight. The pattern may be applied to an auxiliary lens of the device or simply incorporated with an ocular lens. The alignment pattern is adapted to be viewed in only a small area of a target picture as a shooter aims on target. In preferred embodiments, the alignment pattern is adapted to be viewed only within the central region of the target picture.

In practice, a marksman positioning device is used with a sight that has been fitted to a firearm, the sight being adjusted to depict a reticle cross hair impact point or other aiming element to intersect with a projectile trajectory provided by the firearm. To obtain consistent eye placement, a marksman positions himself to perceive the same reticle and alignment pattern correlation that was viewed when the sight was adjusted or "zeroed" to the projectile trajectory.

In a first aspect of the present invention, an auxiliary lens is manufactured from a relatively transparent material that is adapted to be fixed directly to an ocular lens. In a preferred embodiment, the material is pliable and fixed to the ocular lens without epoxy, glue, or other permanent adhesives. Instead, the pliable material is held to the ocular lens by forces of suction, static cling, or similar surface attractions so that the device may be easily removed from the ocular lens without damage to the sight.

In a second aspect of the invention, a marksman positioning device further comprises a frame for securing an auxiliary lens to an optical sight. In one embodiment, the frame is relatively rigid and planar and is threaded to engage the external, posterior portion of a sight. In another embodiment, the frame is elastic and tubular to fit tightly over an ocular housing of a sight.

In a third aspect of the invention, the marksman positioning device comprises an alignment pattern made integral with an ocular lens of an optical sight. In preferred embodiments, the pattern is etched or machined on one of the planar surfaces of the ocular lens.

An alignment pattern of the present invention is adapted for correlating with a reticle of an optical sight. The pattern is of such size and location with respect to its associated lens that, when looking through an optical sight with the device installed, the pattern appears only within a small portion of the target picture. The overall size and characteristics of the pattern allow a marksman to easily find and view the pattern and reticle simultaneously while aiming at a target and facilitates re-positioning with minimal disruption to the connection between marksman and firearm.

BRIEF DESCRIPTION OF THE DRAWINGS

For illustration purposes, embodiments of the marksman positioning device are shown and described as attached to a telescopic rifle scope. However, the invention is suitable and intended to be claimed for other types of optical sights and firearms.

DETAILED DESCRIPTION OF THE INVENTION

Figure 1:
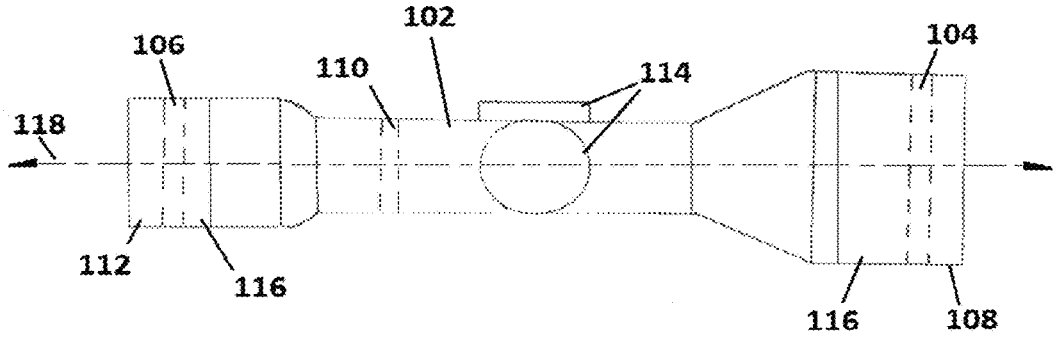
FIG. 1 is a side view of a typical optical sight having an ocular lens.

Unless otherwise specified, the terms defined below are intended to have their broadest possible meaning within the requirements of the law. As used throughout this specification:

The term "aim point" refers to a point of a reticle in a target picture of an optical sight that coincides with an expected projectile trajectory at target impact. Typically, the aim point of an optical sight is overlaid upon a target for the purpose of intersecting the target with a fired projectile when shooting at the target from a distance for which the sight and a corresponding firearm were zeroed.

The term "alignment pattern" or "pattern" refers to a geometric indicator used in correlation with a reticle or similar aiming element of an optical sight to assess the need for adjustment of shooter position. The alignment pattern of preferred embodiments of the present invention is integral or in contact with an auxiliary or ocular lens and is small enough to be viewable only in a small area of the target picture provided by an optical sight.

The term "auxiliary lens" or "lens" when used in the context of referencing a component of the present invention most closely associated with an alignment pattern refers to a relatively transparent or perforated component through which light is intended to pass, whether or not the light is concentrated, dispersed, or unaltered. To be clear, an auxiliary lens of the present invention may or may not be comprised of a curved planar surface to alter the properties of light passing through and may simply be a substrate for supporting an alignment pattern.

The term "area" when used in the context of describing a portion of a target picture or reticle of an optical sight refers to the perceived area as it is imaged, shown, or otherwise provided to a shooter looking through the sight.

The term "central axis" refers to an imaginary line running through the center points of the objective and ocular lenses in a scope or its equivalent with respect to an alternative type of optical sight.

The term "central region" is intended to refer to an area in the center of a target picture or an auxiliary lens. In either case, the central region is understood to have an area of no more than one third of the total area of the target picture or the auxiliary lens.

The term "firearm" refers to various types of small arms such as a rifle, shotgun, pistol, or bow capable of providing a projectile trajectory that may be aimed by using an optical sight.

The term "lens" when used in the context of referring to a part of an optical sight refers to a relatively transparent component or set of components of an optical sight through which light is intended to pass for judging the aim of the sight. A "lens" of an optical sight should be understood to include single or multiple transparent components, according to the design of the sight.

The term "ocular" or "ocular lens" refers the most posterior lens or set of lens components of an optical sight prior to a marksman positioning device being installed. To be clear, when the optical sight is used, the ocular is situated on the shooter's end of the sight whereas in contrast the objective is situated on the end of the sight furthest from the shooter.

The term "optical sight" includes pistol or rifle scopes and other aiming devices incorporating a reticle and at least one lens.

The term "scope" refers to a typical optical sight used with small arms having a reticle or similar aiming element and an objective lens and an ocular lens.

The term "target picture", also known as "sight picture" refers to an image comprising a target and reticle that is provided by an optical sight when viewed through the sight's ocular lens.

With the above definitions in mind, the present invention is directed to a marksman positioning device adapted for enhancing the function of an optical sight through consistent shooter positioning.

Shown in FIG. 1 is an optical sight contemplated for use with the present invention. In this example, the sight 102 is a typical scope designed for mounting on a rifle. The basic structure of the scope resembles a closed cylinder with an objective lens 104 at one end and ocular lens 106 at the other. Light is gathered through the objective lens 104 at the anterior end 108 and passes past a reticle 110 along the interior of the sight 102. The reticle 110 in combination with an image of the target, i.e. a "target picture", is viewable through the ocular lens 106 at the posterior end 112 of the scope.

The primary purpose of the target picture is to predict the placement of a projectile to be fired by the rifle. The perceived relationship between the reticle and the target can be set by manipulating knobs 114 on the exterior of the scope. The exterior also includes threaded lens housings 116 for focusing the target picture. When the scope is combined with a rifle and the reticle properly adjusted, aiming the rifle at a target will generally show the reticle to be on target when both are viewed together through the scope.

The target picture is visible to a shooter positioned with his eye behind the posterior lens or "ocular" 106 of the scope. However, small variations in shooter position may distort the target picture due to parallax error, particularly if the shooter's eye is positioned off center and the focus of the target image and reticle are set on different planes. If the shooter fires while the target picture is affected by parallax, the sight will be a less accurate predictor of the rifle's projectile placement.

To reduce or eliminate parallax error, the position of the shooter's eye is preferably centered as nearly as possible to the central axis 118 of the scope, and the scope correctly focused when the scope is being adjusted or "zeroed" for an actual trajectory produced by the rifle. Moreover, the position of shooter's eye should be reliably referenced so that subsequent positions taken by the shooter with respect to the scope are identical to the position used when the scope was adjusted to the firearm.

Figure 2:
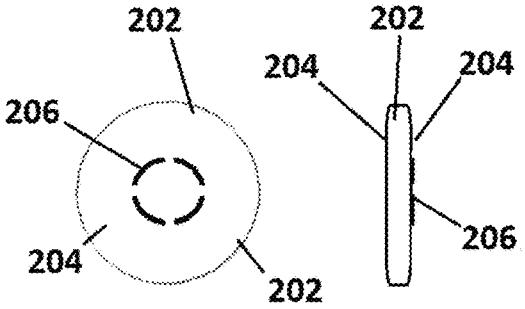
FIG. 2 is a front and side view of a marksman positioning device that is adapted to attach to the exterior planar surface of an ocular lens.

Shown in FIG. 2 are front and side views of a simple embodiment of a frameless marksman positioning device according to a first aspect of the present invention. The device includes an auxiliary lens 202 having two opposing planar surfaces 204 and an alignment pattern 206 according to the present invention. In this embodiment, the lens 202 is manufactured of a pliable material which allows the device to be installed on an optical sight by pressing it against the outside surface of the sight's ocular lens. The pattern is printed on one surface 204 of the auxiliary lens 202 and has a shape that is adapted to align with a small area in the central region of a target picture after the device has been installed on the sight.

When installed, the device shown in FIG. 2 covers approximately one half of the exterior surface of an ocular lens, yet the overlap of the alignment pattern is limited to the central region of the ocular. In other embodiments, an auxiliary lens component of a frameless device in accordance with the first aspect of the present invention may be in contact with more or less of the exterior surface of an existing ocular lens. In some embodiments of a frameless device according to the present invention, the auxiliary lens is approximately the same size as the alignment pattern and includes a central perforation, such that the device takes the form of a ring.

Referring now to the invention in general, auxiliary or ocular lenses of the present invention can be manufactured from various materials so long as they are relatively transparent or perforated, i.e. allowing enough light to pass through so that the aim of the firearm and optical sight to which the device is attached can be adequately perceived by a shooter. Depending on the material used in the manufacture of the lens, the alignment pattern may be applied to the lens in ways that are known in the art. For lenses that are manufactured of harder materials, alignment patterns may be machined, frosted, or etched into the one or both planar surfaces of the lens. Alternatively, patterns may be comprised of materials dissimilar from the material of the lens and applied to one or both of the planar surfaces. Preferably such dissimilar materials are opaque. Alignment patterns comprised of dissimilar materials may be adhered to, deposited or printed on, or cast within a particular lens.

Continuing to refer to the invention in general, auxiliary lenses of the present invention may have one or more curved planar surfaces to refract or otherwise condition light passing through in a way that benefits the shooter. In some embodiments, the auxiliary lens may be a compound lens. Depending on the needs of the shooter, construction and profiles of axillary lenses of the present invention may converge or diverge light as needed for the shooter to focus on or better see the reticle and/or target presented by the sight and/or the alignment pattern of the auxiliary lens. Alternatively, auxiliary lenses of the present invention may be adapted to have no magnifying or corrective effect on the target picture provided to the shooter. In other words, auxiliary lenses of the present invention may function as a plano lens, providing an un-altered target picture. If no correction or other enhancement to the target picture is needed, an alignment pattern may be incorporated into what would otherwise be a standard ocular lens. In other embodiments, an auxiliary lens of the present invention may include a small through hole in its central region, maintaining the original optics of the sight on which it is installed and helping to visualize alignment of the pattern of the auxiliary lens with the reticle of the optical sight.

The present invention provides a reference for the shooter to consistently position his eye with respect to an optical sight so that parallax is reduced or eliminated. Preferably, a device of the present invention is installed on a sight that is already mounted to a firearm and is used to establish an eye position reference for zeroing the sight to the firearm. Moreover, the device is preferably installed and its corresponding optical sight adjusted so that the pattern of the auxiliary lens, aka the alignment pattern, and the aim point of the reticle are aligned as closely as possible through the central axis of the sight. Preferably, the setup is such that the pattern is viewed as concentric with the aim point of the reticle. In any case, with the device, sight, and firearm properly referenced and zeroed, a shooter uses the device to align his eye position by comparing the pattern with the reticle and then modifying his eye position up, down, and/or sideways until the pattern and the reticle are properly arranged. With the pattern and reticle arranged and the aim point of the reticle on target the shooter can be confident that the projectile of the firearm can be placed without error from parallax.

Figure 3:
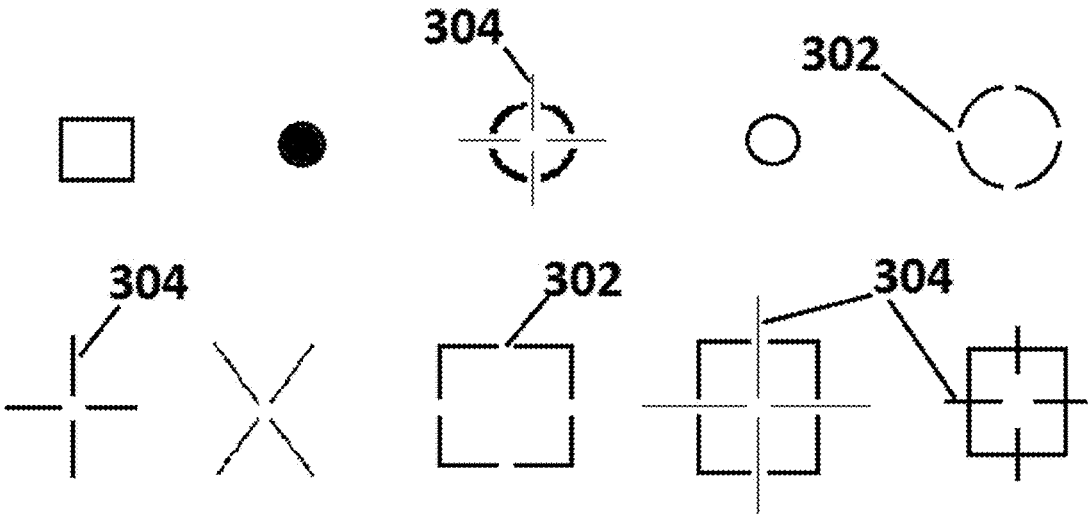
FIG. 3 are examples of several alignment patterns according to the present invention.

Shown in FIG. 3 are examples of alignment patterns of the present invention to be used in comparison with various optical sight reticles. In preferred embodiments, patterns are adapted for appearing to a shooter as laying over a reticle in a symmetrical and/or concentric manner. Some embodiments of the present invention include patterns with gaps 302 for indexing between horizontal and vertical components of cross-hair reticles. Other embodiments include patterns with cross-hair like elements 304 for comparison to cross-hair reticles of optical sights. In further preferred embodiments, alignment patterns are adapted for positioning the shooter so that pattern cross-hair elements overlap horizontal and vertical cross hair components of the reticle in the optical sight, essentially disappearing from the shooter's view when the pattern and reticle are completely aligned.

Referring again to the invention generally, alignment patterns are preferably small and coincide with a small area of a target picture in which the reticle aim point is found. In addition, a particular alignment pattern shape should be chosen that is easily indexed against the type of reticle with which it must be arranged to eliminate parallax. Patterns may comprise circles, ovals, or polygons and lines and other features that radiate outward from the geometric center of the pattern to follow or be contrasted with vertical and/or horizontal components of reticles. However, the size of such features should be limited so that the overall size of the pattern does not exceed ⅓ of the area of a target picture when the pattern and the target picture are viewed together through a sight.

Figure 4:
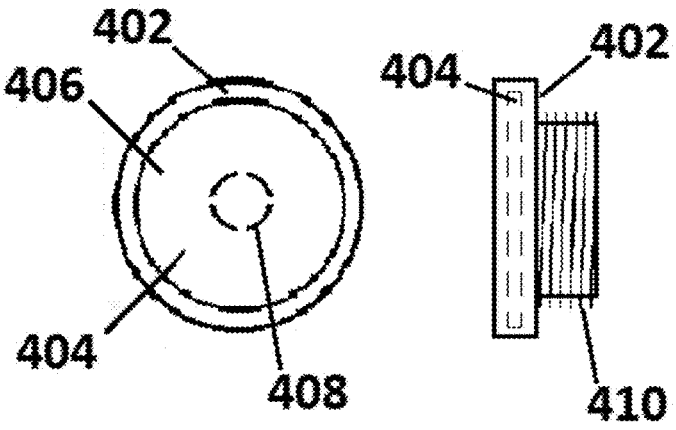
FIG. 4 is a front and side view of a marksman positioning device having a threaded rigid frame.

Shown now in FIG. 4, is a marksman positioning device of the present invention before installation on an optical sight. The device is comprised of a round, rigid frame 402 surrounding an auxiliary lens 404. On the outer surface 406 and limited to the central region of the auxiliary lens 404 is small alignment pattern 408. The frame 402 contains perimeter threads 410 to engage existing threads of an ocular housing on the exterior of an optical sight, posterior to the ocular lens of the sight (not shown).

Figure 5:
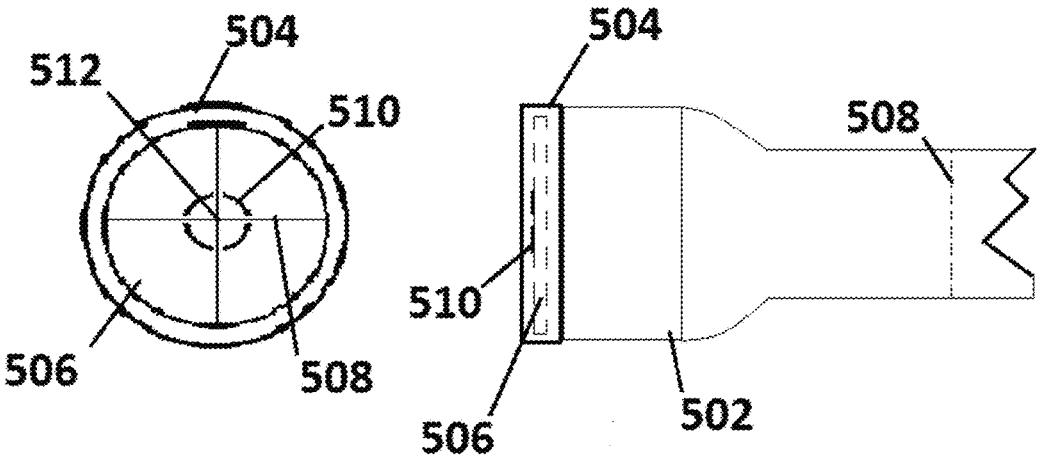
FIG. 5 is a front and side view of the marksman positioning device of FIG. 4 installed on a typical optical sight showing the pattern and reticle in concentric alignment.

The marksman positioning device of FIG. 4 is easily installed on the posterior end of a rifle scope by threading the device into the ocular bellhousing 502, as shown in FIG. 5. The rigid frame 504 of the device is fixed to the auxiliary lens 506 and after installation, prevents the auxiliary lens 506 from moving with respect to the sight. The reticle 508 of the sight is a simple cross-hair type and the alignment pattern 510 is a gapped circle shown in concentric alignment with the aim point 512 of the reticle 508. With the pattern 510 and reticle 508 viewed by a shooter in this configuration, the sight is zeroed by a shooter to a rifle (not shown) for a particular trajectory and distance. To consistently position himself for reducing parallax error, the shooter reproduces the pattern and reticle arrangement shown in FIG. 5 when subsequently shooting projectiles with similar trajectories at similarly distanced targets.

In other embodiments, marksman positioning devices may be provided with tubular frames adapted to fit closely over the outside of ocular bellhousings rather than being threaded on for installation to an optical sight. The frames may be rigid or flexible but should provide a secure fit to the sight when installed. In one embodiment, a marksman positioning device is comprised of an auxiliary lens having a pattern that is housed in a rigid, tubular frame. The interior of the frame includes a circular groove around its inner circumference that partially captures a large O-ring. The device, when installed over the ocular bellhousing of an optical sight, sandwiches the O-ring between the frame and the bellhousing to produce a rigid connection between the device and the optical sight.

Figure 6:
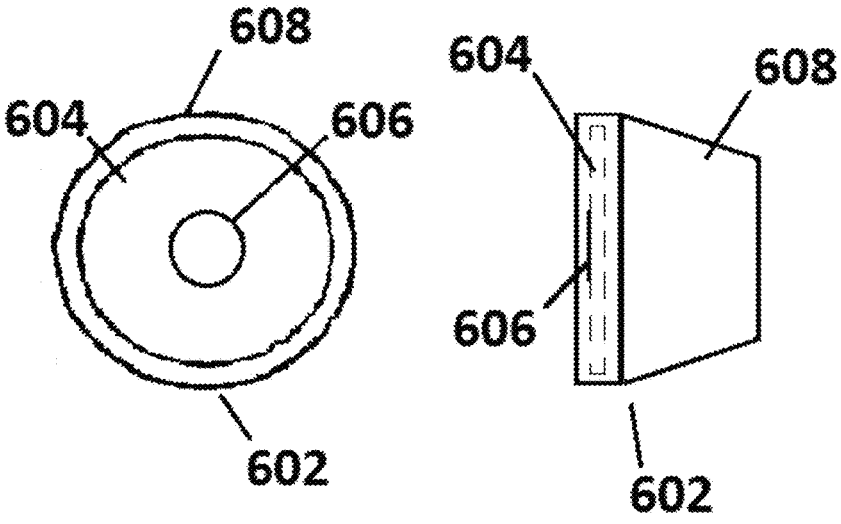
FIG. 6 is a front and side view of a marksman positioning device with a semi-rigid frame for installing over an ocular housing.

In other embodiments, tubular frames are constructed of elastic materials that are adapted to be stretched over oculars of optical sights. Shown now in FIG. 6, is an embodiment of a marksman positioning device 602 of the present invention comprising an auxiliary lens 604, an alignment pattern 606, and a semi-flexible elastic frame 608 for installing the device 602 over an ocular housing of an optical sight (not shown). The alignment pattern 606 is situated in the central region of the auxiliary lens 604 and may be used to align with a central region of the target picture produced by a sight to which the marksman positioning device is installed. In this embodiment, the pattern 606 is a circle adapted to be concentrically aligned with the aim point of the reticle of the intended optical sight (not shown). The pattern shape and configuration is such that it is easily compared with the reticle of the intended sight, so that any misalignment can be quickly recognized and corrected. A shooter using the marksman positioning device to avoid parallax produced by a particular optical sight adjusts his position with respect to the device while looking through the sight until the pattern is properly indexed against the reticle of the sight. Preferably, the firearm would have been zeroed and the marksman position initially determined with respect to the pattern and reticle as each were made concentric around the central axis of the optical sight.

The marksman positioning device shown in FIG. 6 may alternatively be made concentric with a reticle aim point that is outside the central region of the target picture of an optical sight for a given distance and for a particular firearm projectile trajectory, so long as the correlation used between the alignment pattern and optical sight reticle remain consistent during and after the device is used to help zero the firearm fitted with the sight. Similarly, in other embodiments, a marksman positioning device may comprise an alignment pattern outside the central region of an auxiliary lens, either to be arranged with a point or area in the central region of a target picture or with a point or area outside the central region of the target picture so long as a consistent arrangement of pattern and reticle is applied both while and after the device is used to help zero the firearm.

Whether or not a marksman positioning device embodiment of the present invention includes a frame for installing on an optical sight, preferred embodiments incorporate small alignment patterns situated in the central region of an auxiliary or ocular lens. Alternatively, alignment patterns may be offset on an auxiliary or ocular lens. Similarly, an optical sight fitted with a marksman positioning device of the present invention may be adjusted or zeroed for a particular trajectory distance while the alignment pattern is referenced to a vertical feature of the reticle, not necessarily in the center of the target picture. In any case, to reduce parallax, the shooter should always reproduce the alignment arrangement of the pattern and reticle to duplicate what was observed when the device was used to reference his eye position when the sight was zeroed to the firearm.

Figure 7:
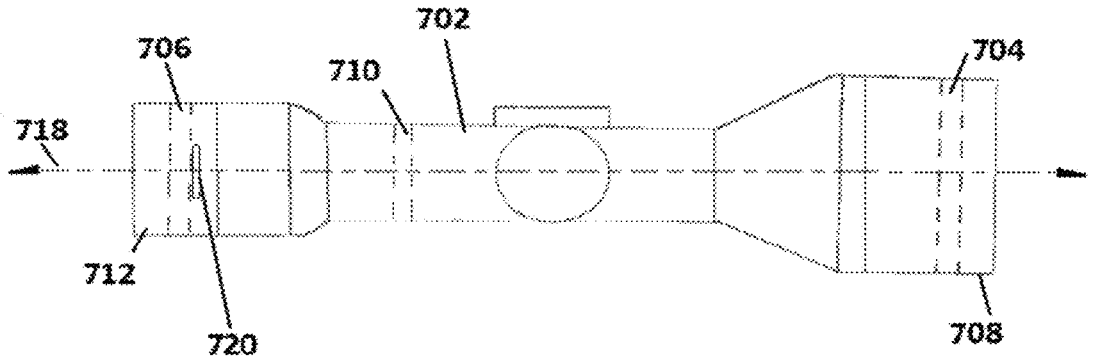
FIG. 7 is a side view of an enhanced optical sight having an alignment pattern applied to its ocular lens.

Shown in FIG. 7 is an optical sight manufactured to include a marksman positioning device. In this embodiment, the sight 702 is a scope designed for mounting on a rifle. The scope comprises a cylindric central portion having a reticle 710 between anterior and posterior housings. Within the anterior housing 708 is an objective lens 704 and within the posterior housing 712 is an ocular lens 706 on which an alignment pattern 720 is applied according to the present invention. The objective 704 and ocular 706 lenses and the reticle 710 are each located within the scope concentric with the central axis 718.

The alignment pattern 720 is a circle adapted to be arranged with an aim point of the reticle 710 and is situated in a central region of the ocular lens 706. The pattern shape and configuration are such that the alignment pattern 720 is easily compared with the reticle 710, so that any misalignment can be quickly recognized and corrected while looking at a target picture.

A shooter using the scope in FIG. 7 to avoid parallax adjusts his position with respect to the ocular while looking through the sight until the pattern 720 is properly indexed against the reticle 710 of the sight 702. In other words, the shooter continues to change the position of his eye behind the scope until the arrangement of the alignment pattern 720 and the reticle 710 appear the same as when the scope was zeroed to the rifle.

It is preferable that optical sights incorporating an alignment pattern with an ocular lens are manufactured to apply the alignment pattern to the interior planar surface of the ocular lens. However, in alternate embodiments, optical sights may be manufactured with an alignment pattern on the exterior planar surface or incorporated within the casting of an ocular lens. As with the manufacture of auxiliary lenses, alignment patterns may be applied to ocular lenses by machining, frosting, etching, printing, or casting.

The drawings and related descriptions disclosed herein are provided as samples of preferred embodiments of the present invention without intending to be restrictive or limiting in scope. To the contrary, the disclosure is intended to cover all equivalents, combinations, modifications, additions, deletions, and alternate constructions falling within the spirit and scope of the invention, as set forth in the appended claims.

I claim:

1. A marksman positioning device comprising:

An elastic frame configured to stretch over an ocular housing of an optical sight;

An auxiliary lens enclosed by and fixed in position with respect to the optical sight by said frame, said auxiliary lens having a central region viewable through the frame;

An alignment pattern carried by said auxiliary lens, said alignment pattern configured to align with a reticle of a target picture provided by the optical sight, said alignment pattern having a geometry confined to the central region of the auxiliary lens; and said alignment pattern comprises A plurality of gaps configured for aligning with the reticle for precise projectile placement, whereby consistent positioning of a marksman is achieved by reproducing a view of the alignment pattern position with respect to the reticle.

2. The marksman positioning device of claim 1 wherein the frame is tubular and configured to fit closely over the ocular housing.

3. A marksman positioning device comprising:

A frame configured to attach to an ocular housing of an optical sight, said frame having external threads to threadably engage the ocular housing;

An auxiliary lens enclosed by and fixed in position with respect to the optical sight by said frame, said auxiliary lens having a central region viewable through the frame;

An alignment pattern carried by said auxiliary lens, said alignment pattern configured to align with a reticle of a target picture provided by the optical sight, said alignment pattern having a geometry confined to the central region of the auxiliary lens; and said alignment pattern comprises A plurality of gaps configured for aligning with the reticle for precise projectile placement, whereby consistent positioning of a marksman is achieved by reproducing a view of the alignment pattern position with respect to the reticle.

4. The marksman positioning device of claim 3 wherein the frame is rigid and planar.

5. The marksman positioning device of claim 1 wherein the alignment pattern is applied to the auxiliary lens in a position concentric with a reticle aimpoint of the optical sight.

6. The marksman positioning device of claim 1 wherein the alignment pattern is comprised of a print or frost on the auxiliary lens.

7. The marksman positioning device of claim 1 wherein the alignment pattern is comprised of an etch on the auxiliary lens.

8. The marksman positioning device of claim 1 wherein the alignment pattern is created by machining the auxiliary lens.

9. The marksman positioning device of claim 1 wherein the auxiliary lens further comprises a curved planar surface to magnify or correct the target picture to aid the eyesight of a shooter.

10. The marksman positioning device of claim 3 wherein the alignment pattern is applied to the auxiliary lens in a position concentric with a reticle aimpoint of the optical sight.

11. The marksman positioning device of claim 3 wherein the alignment pattern is comprised of a print or frost on the auxiliary lens.

12. The marksman positioning device of claim 3 wherein the alignment pattern is comprised of an etch on the auxiliary lens.

13. The marksman positioning device of claim 3 wherein the alignment pattern is created by machining the auxiliary lens.

14. The marksman positioning device of claim 3 wherein the auxiliary lens further comprises a curved planar surface to magnify or correct the target picture to aid the eyesight of a shooter.

* * * * *